United States Patent [19]

Hideg et al.

[11] Patent Number: 4,526,152

[45] Date of Patent: Jul. 2, 1985

[54] LOW PRESSURE LOW COST AUTOMOTIVE TYPE FUEL INJECTION SYSTEM

[75] Inventors: Laszlo Hideg, Dearborn Heights; Paul L. Koller, Wyandotte; Rogelio G. Samson, Bloomfield Hills, all of Mich.

[73] Assignee: Ford Motor Company, Dearborn, Mich.

[21] Appl. No.: 570,052

[22] Filed: Jan. 12, 1984

[51] Int. Cl.[3] ..... F02M 39/00; F02M 37/20

[52] U.S. Cl. ..... 123/478; 123/472; 123/514; 123/434

[58] Field of Search ..... 123/472, 478, 516, 434, 123/495, 508, 514, 518, 540, 541, 461, 463

[56] References Cited

U.S. PATENT DOCUMENTS

| | | | |
|---|---|---|---|
| 3,332,476 | 7/1967 | McDougal | 123/540 |
| 4,036,071 | 3/1984 | Hafner et al. | 123/434 |
| 4,084,564 | 4/1978 | Rickart | 123/514 |
| 4,187,813 | 2/1980 | Stumpp | 123/541 |
| 4,195,608 | 4/1980 | Sanada et al. | 123/514 |
| 4,212,277 | 7/1980 | Melotti | 123/434 |
| 4,286,562 | 9/1981 | Stoltman | 123/463 |
| 4,341,193 | 7/1982 | Bowler | 123/472 |
| 4,347,823 | 9/1982 | Kessler et al. | 123/478 |

*Primary Examiner*—Raymond A. Nelli

*Attorney, Agent, or Firm*—Robert E. McCollum; Clifford L. Sadler

[57] ABSTRACT

A very low pressure fuel injection system uses an engine driven mechanical fuel pump to supply fuel at low pressure to a fuel devaporizing chamber normally filled with liquid fuel and in which is immersed the body portion of an electronically opened fuel injector positioned to spray fuel axially into the upper end of the induction passage of an air throttling body, the chamber containing a fuel pressure accumulator and a fuel pressure regulator maintaining the fuel pressure at a level slightly below the pump delivery pressure and at the injection level, the fuel chamber being rapidly purged of vapors during engine cranking and running operations.

7 Claims, 2 Drawing Figures

LOW PRESSURE LOW COST AUTOMOTIVE TYPE FUEL INJECTION SYSTEM

Figures 1, 2:
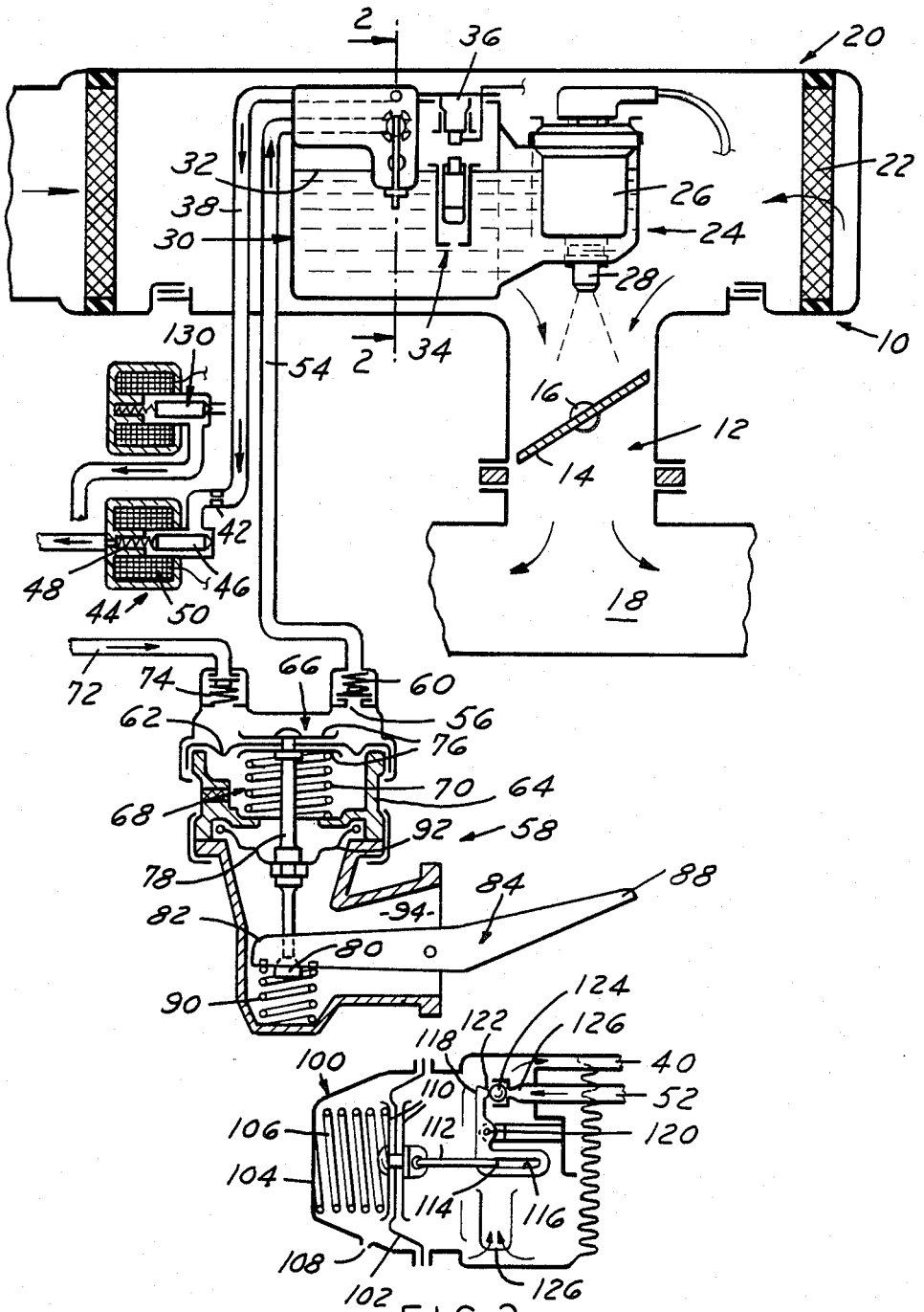

This invention relates in general to a very low pressure fuel injection system of the automotive engine type. More particularly, it relates to a single point central fuel injection system for supplying fuel to a low pressure fuel injector centrally located in the induction passage of an air throttling body.

A primary object of the invention is to provide a low cost fuel injection system that uses a mechanical type fuel pump to supply fuel at very low pressures, in the range of 2–10 psi or thereabouts, to a solenoid operated fuel injector, this being accomplished with the use of a fuel devaporizing chamber from which fuel vapors are rapidly purged during engine cranking and running operations to maintain a constant fuel injection pressure level even though the pump may be providing only partial liquid fuel delivery.

The trend in automotive type fuel injection systems has been toward the use of high pressure fuel systems utilizing fuel injectors that operate at pressure levels high enough to discourage fuel vaporization, which can complicate fuel delivery and pressure schedules. In general, the higher the fuel pressure, the lower the vaporization. The conventional engine driven mechanical fuel pump, while low in cost, has an output fuel pressure level of approximately 5 psi, which would not be satisfactory for high pressure fuel injection systems. Accordingly, far more expensive electric in-tank type fuel pumps have been used.

To lower the cost, therefore, the use of a conventional diaphragm type mechanical fuel pump, coupled with an electronic fuel injection system operating in a 2–10 psi pressure range would be preferable. Utilizing such a pump, however, increases vaporization of the fuel with temperature increase. Other problems also surface, such as, for example, difficulty in fuel pickup from the fuel tank against a head of several inches of water; lubrication of pump components by hot engine oil and proximity of the pump to the engine causing substantial heating of the fuel; a highly reduced rate of pump delivery during cranking due to increased vaporization and inefficiency of the pump at low cranking speeds; and, in certain pump designs, highly fluctuating delivery pressures. These problems, for example, may result in delivery of large volumes of fuel vapor especially during cranking, and substantial vapor volumes in the liquid fuel after startup under hot soak and hot ambient engine conditions.

The invention overcomes the above disadvantages by incorporating in the system a fuel devaporization chamber that normally is filled with liquid fuel, and contains the fuel injector for cooling it, and also contains a fuel pressure accumulator and a fuel pressure regulator operable to maintain a constant fuel injection pressure level at all times regardless of the low fuel delivery volume of the pump due to fuel vapor formation.

More specifically, the invention provides a fuel injection system in which a low pressure mechanically actuated fuel pump delivers fuel to a liquid fuel chamber/-reservoir maintained at a pressure level slightly lower than the output pressure level of the pump by a fuel pressure accumulator that controls a fuel pressure regulator and has a fuel volume displacement sufficient to satisfy the critical fuel injector requirements of the engine even under extreme hot ambient temperature engine operating conditions that result in substantial vapor buildup.

Low pressure single point fuel injection systems per se are known. For example, U.S. Pat. No. 4,212,277, Melotti, shows such a system with a heat insulating gasket member 47 between the plastic upper body and the lower body portion of the throttle body. A fuel accumulation chamber 30 is provided with slanted fuel passages to aid in devaporization. The injector housing, however, is not immersed in the devaporization chamber, and the fuel accumulation chamber does not have a displaceable volume control to maintain a constant fuel pressure to the injector at all times regardless of hot fuel handling operation of the pump. The pump is stated to be conventional; however, no heat insulating features of the pump are shown or taught. Also, there is no provision for controlling the fuel return flow line to control engine cranking and other operations.

U.S. Pat. No. 4,195,608, Sanada et al, shows a carburetor float bowl with a fuel line 18 traversing the float bowl to cool the fuel to decrease the formation of vapor. However, there is no flow of intake air cleaner air over the float bowl, and the system is not a fuel injection system.

U.S. Pat. No. 2,414,158, Mock, shows in FIG. 2 a fuel devaporization chamber 68 that collects liquid fuel and vents fuel vapors through an outlet 74 controlled by a float valve 152. There is no fuel pressure accumulation chamber with a variable volume displacement to maintain a constant fuel injection pressure at all times regardless of the hot fuel handling conditions of the fuel pump.

U.S. Pat. No. 4,079,717, Shirose, shows in FIGS. 2 and 3 fuel vapor separators for use in a line between a fuel tank and fuel injectors to vent the fuel vapors back to the fuel tank. There is no fuel pressure accumulator with a variable volume displacement to maintain a constant fuel injection pressure even though the pump output should contain mostly fuel vapors.

Other objects, features and advantages of the invention will become more apparent upon reference to the succeeding detailed description thereof and to the drawings schematically illustrating a preferred embodiment thereof; wherein, FIG. 1 is a schematic cross-sectional view of a low pressure fuel injection system embodying the invention; and FIG. 2 is a schematic cross-sectional view taken on a plane indicated by and viewed in the direction of the arrows II—II of FIG. 1.

FIG. 1 discloses a carburetor type air throttling body 10 of the downdraft type having an air/fuel induction passage 12. It contains a disc-like throttle valve or plate 14 fixed on a shaft 16 rotatably mounted in the walls of the throttle body for movement between the closed position shown and an essentially vertical position for controlling air/fuel flow through the passage. The lower end of passage 12 is adapted to be connected as shown to the intake manifold 18 of an automotive type internal combustion engine, not shown, for subjecting the passage to the varying engine manifold pressure levels of the engine during operation.

The upper end of passage 12 is open to air at an essentially atmospheric pressure level and over which is located an air cleaner assembly 20. The latter includes the usual annular dry element air cleaner filter 22 through which air is inducted in the direction of the arrows shown.

Located within the air cleaner directly over the open end of induction passage 12 is an electronically controlled fuel injection assembly indicated in general at 24. It includes an outer annular housing 26 within which is operable a low pressure fuel injector indicated schematically at 28. The injector in this case is located with its axis extending along the axis of passage 12 to provide a conical spray, as indicated by the dotted lines, of fuel into the passage.

The main body of the fuel injector housing 26 is immersed, as indicated, in a liquid fuel chamber or reservoir 30, not only for its fuel supply, but also for cooling purposes. The chamber normally would be full of liquid. However, under hot soak or hot ambient engine operating conditions, heavy vaporizing of the fuel may reduce the liquid to a level such as indicated at 32. Therefore, the chamber also contains a conventional liquid level float member, the end view of which is indicated schematically at 34, that has a Hall effect type magnetic head 35 adapted to cooperate with a mating head on an electronically controlled fuel level sensor 36. When the two heads separate due to a drop in the fuel level, an electrical signal is generated to a fuel shutoff valve, described later, to maintain open a fuel return line 38, to purge the chamber of vapors, in a manner to be described.

The liquid fuel chamber 30 contains a fuel outlet 40 located near the highest point of the chamber. It is connected by line 38 to the main fuel tank, not shown, past a flow restricting orifice 42 and a normally open, solenoid closed fuel shutoff valve assembly 44 previously referred to. The latter valve is normally closed during engine cranking operations so that the return line 38 will be blocked to permit a rapid buildup of fuel pressure in chamber 30, in a manner to be described. The shutoff valve assembly 44 consists of a reciprocable valve 46 biased by a spring 48 to an open position and moved leftwardly as seen in FIG. 1 upon energization of an electromagnetic coil 50 to block the line.

Chamber 30 also contains a liquid fuel inlet 52 (see also FIG. 2) located just below outlet 40 that is supplied with fuel from a pump supply line 54. The latter receives fuel from the outlet 56 of a mechanically operated fuel pump assembly 58 through a spring closed fuel check valve 60. More particularly, the pump assembly 58 is of the low pressure mechanical type adapted to be reciprocated by the engine camshaft, not shown, in the usual manner. It has an annular diaphragm 62 partitioning a metal pump housing 64 into a fuel chamber 66 and a spring chamber 68 in which is located a compression spring 70. Fuel is supplied from the main storage tank, not shown, to fuel chamber 66 through a spring closed fuel inlet check valve 74, and is expelled from the chamber during the pumping stroke through the outlet check valve 60.

Diaphragm 62 is connected by a pair of retainer plates 76 to an actuating link or rod 78 having a button end 80. The latter engages with the yoke end 82 of a pump bellcrank lever 84 fulcrumed at 86 on the pump housing. The opposite end of lever 84, as stated previously, is adapted to be engaged by the camshaft of the internal combustion engine, in a known manner, for periodically rocking the lever to effect movement of diaphragm 62 through its fuel intake and pumping strokes. Upward movement of end 88 of lever 84 will move the rod 78 downwardly on a fuel intake stroke against a return spring 90 and against the bias of main spring 70 to open check valve 74 while closing check valve 60 to admit fuel into the chamber 66 to fill the same. Subsequent downward movement of the end 88 of lever 84 will release the rod 78 to permit spring 70 to move diaphragm 62 upwardy through a pumping stroke to shut inlet valve 74 while opening outlet valve 60 to thereby supply liquid fuel under pressure to supply line 54 and chamber inlet 52.

The lever 84 and the interior portions of the lower part of the pump housing are subjected to splashing hot lubricating oil from the engine. To isolate the heat of the oil from diaphragm 62, an annular elastic boot 92 separates spring chamber 68 from lower oil chamber 94. Similarly, the intermediate portion 64 of the pump housing that surrounds and encloses spring 70 can be made of a heat insulating material rather than the conventional metal, to reduce exposure of the pump fuel chamber 66 to heat.

With the engine off under hot ambient or hot soak conditions, considerable fuel in chamber 30 may boil off or evaporate, making it difficult for pump 58 to quickly supply liquid fuel to the fuel injector for startup cranking operations. In this case, a fuel pressure accumulator assembly 96, shown more clearly in FIG. 2, is provided in conjunction with a pressure regulator valve assembly 98 to maintain sufficient liquid fuel volume at the injection pressure at all times regardless of the pump not providing full liquid fuel volume delivery, that is, regardless of the fuel vapor conditions.

More specifically, the fuel pressure accumulator assembly is adapted to be inserted through a hole in the side of fuel chamber 30 with an annular flexible diaphragm 102 closing the hole. A cover housing 104 that projects outwardly from the fuel chamber for enclosing a charging spring 106 is subjected to atmospheric pressure conditions through a vent 108. Diaphragm 102 is riveted to a pair of annular disc-like spacers 110 that are connected to a link 112. The link has an inturned end 114 captured and slidable in a lost motion type slot 116 formed in one end of a bellcrank lever 118. The latter is fulcrumed at 120 on a portion of the housing of the accumulator assembly, the upper end being formed with a button end 122 engageable with a ball type pressure regulator valve 124. The latter is movable against a seat in a passage 126 that is connected to the fuel inlet 52 and pump supply line 54 (FIG. 1).

In the absence of a fuel pressure in the accumulator chamber against the right side of diaphragm 102 (FIG. 2) greater than the force of charging spring 106, the diaphragm will move rightwardly under the force of the spring to supply fuel at the injection pressure level to the injector through a fuel inlet indicated schematically at 126.

To summarize, the major components of the system include the fuel vapor separator and fuel cooling chamber 30 under an injection pressure level providing a constant liquid fuel supply for fuel injector 28, an electronically controlled liquid level sensor 36, a fuel return flow line 38 to the fuel tank containing a fuel return flow control orifice 42, a return line shutoff solenoid valve assembly 44, and a fuel pressure accumulator assembly 96 and pressure regulator assembly 98 designed to fit the requirements of the ultra low pressure fuel supply pump.

In operation, fuel is supplied from the main fuel storage tank by fuel pump 58. Pump lever 84 compresses pump diaphragm spring 70 to charge the pumping chamber 66 with fuel through inlet valve 74. Release of the lever releases diaphragm 62 permitting spring 70 to force fuel through the pump outlet valve 60. The supply pump delivery pressure will be determined as a function of the size of the diaphragm and the force of spring 70. The pump displacement volume usually will be designed to be about ten to thirty times, for example, as great as the maximum liquid fuel delivery requirements. This enhances rapid fuel vapor evacuation and liquid fuel pickup from the pump suction or intake line during hot cranking conditions. For electronic fuel injection, the fuel supply pump delivery pressure will be designed to be slightly greater than the injection pressure.

The fuel from supply line 54 enters devaporization chamber 30 near the top of the chamber. Under normal operating conditions, as stated previously, the chamber will be filled with pressurized liquid fuel. Any fuel bubbles present will float to the top of the chamber and exit therefrom with the return fuel into the fuel tank, the recirculation flow rate being controlled by the size of orifice 42. The fuel chamber pressure will be determined by the size of the pressure accumulator diaphragm 102 and the force of charging spring 106, and is set only slightly lower than the delivery pressure of the supply pump. The displacement volume of the pressure accumulator by spring 106 will be sufficiently large to prevent total loss of injection pressure at the highest vapor to liquid fuel volume ratios that occur in the system under hot operating conditions other than cranking.

In well designed systems the accumulator volume will be approximately five to fifteen times, for example, as great as the critical liquid fuel volume delivery requirements during any engine cycle. The critical volume is defined as the sum of engine wide open throttle injected fuel volume and the return fuel flow volume during one engine cycle at 1.2 times the idle engine rpm. The spring constant of pressure accumulator spring 106 would be chosen suitably low to assure preferably less than 1% to 2% pressure fluctuations during the intake period of the fuel supply pump 58 under the critical liquid fuel volume delivery conditions will full liquid fuel delivery.

The pressure accumulator 100 also serves as the flow controlling pressure regulator during the delivery period of the fuel pump. At the beginning of the fuel delivery, the fuel freely enters chamber 30 through inlet 52 and strokes the accumulator diaphragm 102 leftwardly (FIG. 2) until it approaches its maximum displacement. At this point, diaphragm 102 through link 112, bellcrank lever 118, and pressure regulator valve 124 restricts the fuel flow into chamber 30 so that it is equal to the fuel flow leaving the chamber through the injector 28 and fuel return flow orifice 42. This process results in maintaining a constant fuel pressure to the fuel injector 28 as determined by the force of spring 106 and the size of diaphragm 102.

The selection of the fuel return flow rate (orifice 42) depends on the engine/vehicle/fuel system packaging design and the degree of thermal isolation of the fuel supply pump and fuel lines, heat insulation under the throttle body, and effectiveness of fuel cooling by the inlet air in devaporization chamber 30. In well designed systems, a return fuel flow equal to the mid engine speed, wide open throttle engine fuel flow is a suitable design guide line.

The primary purpose of the fuel return flow shutoff solenoid valve 44 and the electronic fuel level detector 36 is to ensure a fast engine start under hot cranking conditions. The solenoid valve 44 is normally open to permit fuel return flow under normal engine operation, and to prevent excessive vapor pressure buildup in the system during hot soak when the engine is not running. Under normal engine cranking conditions, the return flow shutoff valve 44 is closed, by means other than sensor 36, during cranking to permit rapid fuel injection pressure buildup. However, if the liquid level in the devaporization chamber 30 is excessively low, as indicated by sensor 36, shutoff valve 44 will be kept open during cranking to permit a rapid evacuation of fuel vapors from the system until the liquid level in chamber 30 is suitably high. Then the valve will close for the remainder of the cranking period permitting buildup of injection pressure and engine starting. Although one solenoid valve usually will be adequate to provide satisfactory operation, the duration of hot-soak engine cranking can be further reduced by the inclusion of a second solenoid controlled valve 130 connected in parallel with the fuel return flow control valve 44 to serve as a larger cross-section vapor purging path bypassing the return flow control orifice 42. The vapor purging valve 130 normally will be closed and opened only when the fuel level is excessively low in devaporization chamber 30, as determined by sensor 36.

The volume of liquid fuel stored in the devaporization chamber 30 and the ultra low injection pressures serve to reduce the hot-soak cranking and startup problems common with the use of engine driven fuel supply pumps. In conventional diaphragm type pumps, the obtainable compression ratio and the maximum vapor delivery pressures are substantially limited. The ultra low pressures described here (2–10 psi), however, can be obtained even when the pump volume and the suction line contain only fuel vapor. Consequently, the injection pressure called for can be obtained in devaporization chamber 30, and the liquid fuel stored can start the engine even when the fuel supply pump 58 delivers only compression vapor during hot-soak cranking.

From the foregoing, it will be seen that the invention provides a very low pressure, single point central fuel injection system that reduces the engine cranking time by rapidly purging the fuel vapors from the system that are the result of hot-soak or hot ambient temperature conditions.

While the invention has been shown and described in its preferred embodiment, it will be clear to those skilled in the arts to which it pertains that many changes and modifications may be made thereto without departing from the scope of the invention. For example, while the invention has been shown in connection with a single point centrally located fuel injection, it is equally adaptable to a single or multi-point manifold injection system.

We claim:

1. A single point low pressure fuel injection system for an automotive type engine, the system including an air throttling body having an induction passage with an electromagnetically operated centrally located fuel injector projecting axially into one end, the passage being connected at its opposite end to the engine intake manifold and having a throttle valve between the injector and manifold rotatably mounted for a movement between positions variably opening and closing the passage, a closed fuel chamber containing liquid fuel, a low pressure engine camshaft driven mechanical fuel pump having an inlet from a fuel tank and an outlet connected to an inlet to the chamber near the top thereof to provide fuel under low pressure thereto in the range of 2–10 psi or thereabouts, a fuel return flow line to the fuel tank connected to the chamber above the chamber inlet and containing a flow restrictor therein, the injector having a body portion immersed in the chamber for supplying fuel to the injector and cooling the injector, an air cleaner assembly surrounding the chamber for directing cooling air past the chamber into the induction passage, and fuel pressure regulator means in the chamber to pressurize the chamber to the injector injection pressure level, the level being slightly lower than the output pressure level of the pump, the pressurization of the chamber effecting a quick purging from the chamber upon operation of the pump of any fuel vapors developed from hot soak or hot fuel handling engine operations to maintain a constant fuel pressure to the injector at all times, the pressure regulator means including a fuel pressure accumulator in the chamber including spring biased piston means displaceable by the fuel pressure to an energy storage position, the maximum accumulator displacement volume being greater than the greatest engine liquid fuel volume delivery requirements during any one engine cycle of operation to maintain a constant fuel injection pressure level at all times regardless of the fuel pump fuel output volume level.

2. A system as in claim 1, the return line containing a normally open fuel line shutoff valve selectively operable to close the line during hot engine cranking conditions to rapidly pressurize the chamber to the fuel injection pressure level.

3. A system as in claim 2, including a liquid fuel level detector in the chamber operable during engine cranking operations to effect opening of the fuel shutoff valve in response to the liquid level attaining a predetermined level to thereby more rapidly purge the reservoir of fuel vapors than when the liquid fuel level is above the predetermined level.

4. A system as in claims 1, or 2 or 3, the return line also containing a normally closed drain port openable at will during cranking operations of the engine to increase the fuel return flow rate to rapidly purge the reservoir of fuel vapors.

5. A system as in claim 4, the fuel shutoff valve and drain port each being solenoid controlled.

6. A system as in claim 1, the pressure regulator means including a ball valve in the connection between the pump outlet and chamber inlet movable to an open position to admit fuel to the chamber and against linkage means, and lost motion means connecting the linkage means to the accumulator piston means to bias the ball valve toward a closing position to thereby regulate the chamber fuel pressure in response to displacement of the piston means toward its maximum fuel volume displacement position.

7. A system as in claim 6, the linkage means comprising a bellcrank lever having a lost motion slot at one end connected by a link slidable in the slot to the piston means, the opposite end of the bellcrank lever bearing against the ball valve.

* * * * *